United States Patent [19]

Parker

[11] 4,260,994

[45] Apr. 7, 1981

[54] ANTENNA PATTERN SYNTHESIS AND SHAPING

[75] Inventor: Ernest G. Parker, Morristown, N.J.

[73] Assignee: International Telephone and Telegraph Corporation, New York, N.Y.

[21] Appl. No.: 959,395

[22] Filed: Nov. 9, 1978

[51] Int. Cl.[3] ..... H01Q 1/50

[52] U.S. Cl. ..... 343/854; 343/100 SA; 343/106 R

[58] Field of Search ..... 343/100 SA, 854, 853, 343/876, 106 R

[56] References Cited

U.S. PATENT DOCUMENTS

| | | | |
|---|---|---|---|
| 3,090,956 | 5/1963 | Woodward et al. | 343/854 |
| 3,560,978 | 2/1971 | Himmel et al. | 343/100 SA |
| 3,670,336 | 6/1972 | Charlton et al. | 343/100 SA |
| 3,845,485 | 10/1974 | Parker et al. | 343/854 |
| 3,846,799 | 11/1974 | Gueguen | 343/833 |
| 3,863,255 | 1/1975 | Iden | 343/854 |
| 4,014,024 | 3/1977 | Parker et al. | 343/876 |

*Primary Examiner*—David K. Moore

*Attorney, Agent, or Firm*—John T. O'Halloran; Peter C. Van Der Sluys

[57] ABSTRACT

An antenna utilizes components of spatial harmonics to synthesis and shape radiation patterns. A counterpoise mounts a monopole radiator as well as a plurality of arrays of parasitic antenna elements excitable by the monopole radiator in a manner to produce the selected harmonics and consequently the desired radiation pattern. The parasitic antenna elements are compensated and are provided with switching to cause their activation. A cone radiator cooperates in exciting the parasitic antenna elements.

9 Claims, 5 Drawing Figures

ANTENNA PATTERN SYNTHESIS AND SHAPING

The Government has rights in this invention pursuant to Contract No. N00123-76-C-1395 awarded by the Department of the Navy.

BACKGROUND OF THE INVENTION

Within the recent past a solid state Tacan antenna has been developed and accepted for shipboard installation. This antenna is an electronically scanned all band (252 channels) antenna system.

In earlier conventional Tacan antennas prior to this development, a rotating inner cylinder carrying a single parasitic element distorts the central antenna elements circular radiation pattern into a cardioid shape at a 15 revolution per second rate, producing the 15 cps modulation of the course bearing signal. There is a direct correspondence between electrical phase and geographical bearing; the single lobed cardioid pattern changes phase in a clockwise direction one degree with each one degree of geographical bearing.

This earlier Tacan antenna also has an outer rotating element, which rotates integrally with the inner cylinder at the same 15 revolutions per second rate. The outer cylinder, however, has nine elements embedded in it, in the form of vertical wires spaced uniformly at 40° intervals. These wires—also parasitic elements—further distort the 15 cps cardioid pattern, producing a ninth harmonic, 135 cps sine wave component that provides the fine bearing indications.

This 135 cps component moves through a complete cycle, or 360 electrical degrees, for each 40° arc of geometrical bearing so that the fine bearing feature produces a 9° change in measured phase for each single degree of bearing change. Thus, a "magnifying" effect produces fine bearing indications.

Of course, the fine bearing indication has a 9-fold ambiguity—the phase would be identical for any of 9 directions that lie 40° apart. To resolve the bearing ambiguity, the course 15 cps signal first moves the airborne indicator into the correct 40° bearing sector after which the fine 135 cps signal precisely positions the indicator within the sector. Once each revolution of the cylinders, a special coded course reference pulse is sent out to serve as a timing reference for the measurement of the phase of the pulse envelope wave. For further details of this earlier conventional Tacan antenna reference is made to the article entitled, "New Tacan Antennas Offer Gains" by Kenneth J. Stein published in the July 24, 1972 issue of Aviation Week & Space Technology.

These mechanically rotated Tacan antennas, although simple and reliable, are bulky, heavy and consume relatively large amounts of primary power.

The basis of the non-rotating electromagnetic wave energy transmitting antenna is the Yagi array disclosed in U.S. Pat. No. 1,860,123 granted May 24, 1932. In a Yagi-type array, several parallel planar dipoles are present including, in order, a not-fed dipole called reflector, a fed dipole called driven dipole and a number of non-fed suitably spaced parasitic dipoles called directors. The Tacan antennas of the non-rotating type are further disclosed in U.S. Pat. Nos. 3,560,978 granted Feb. 2, 1971; 3,845,485 granted Oct. 29, 1974; 3,846,799 granted Nov. 5, 1974; 3,863,255 granted Feb. 2, 1971 and 4,014,024 granted Mar. 22, 1977.

In the electronically scanned Tacan antennas a lightweight, compact configuration is advantageously afforded. The technique employed to achieve the characteristic 15 cps and 135 cps modulation components employs digital control of parasitic elements. A select number of parasitic elements are arranged around the central radiator, and these parasites are digitally switched in a predetermined pattern. The parasitic elements are small dipoles which are effectively detuned by large inductances to prevent current flow. The outer array of parasitics produce the 9th harmonic, 135 cps fine bearing modulation. This electronically scanned Tacan antenna is also described in the foregoing article and is available commercially from the Avionics Division of ITT, Nutley, New Jersey 07110.

The solid state Tacan antenna offered by ITT in its shipboard configuration consists of two major units: an antenna assembly and a control monitor. These units together with the shipboard beacon, provide aircraft with distance and bearing information needed to determine their positions with respect to the ship.

The antenna assembly is designed for installation at the top of a mast. The antenna consists of three major subassemblies: (1) Rf subassembly, pedestal and an electronic subassembly. The RF subassembly is protected by a fiberglass honeycomb randome attached to a lower aluminum sect-on by quick release fasteners.

The RF assembly has replaceable parasitic modules arranged in a circular pattern on an aluminum honeycomb sandwich counterpoise. The inner ring consists of replaceable 15 Hz modules arranged in a circle around a central radiator.

With the acceptance of the ITT solid state electronically scanned antenna system, it was considered advantageous to utilize this configuration and provide for pattern synthesis and shaping for the countless applications envisioned for shipboard use as well as shore illustrations.

Furthermore, it would be extremely desirable to integrate L-band systems along with Tacan. Most of the L-band spectrum has been allocated to aeronautical radial navigation, communications and identification. Within these frequency allocations, many systems have been developed and are in various development status ranging from operational to advanced development. Therefore, electromagnetic waves propagation in the L-band spectrum coupled with Tacan would have many applications.

SUMMARY OF THE INVENTION

This invention relates to a method of locating antenna parasites to achieve desired spatial harmonics in an antenna radiation pattern using Fourier analysis for patten synthesis.

Thus, a principal object of the present invention is through the use of spatial harmonics and with appropriate control logic, to provide an antenna system possessing complete flexibility to produce variable pattern shaping or shapes.

An object of the invention is to deploy parasitic elements for producing and controlling spatial patterns formed by spatial harmonics (1st–8th) adjusted in phase and amplitude and generated by ring arrays adjusted in radius.

Another object is to independently generate and control fundamentals utilizing these ring arrays for other harmonics (beyond the 9th) as well to satisfy other contemplated applications.

A further object is to independently control each harmonic and in this manner the spatial pattern shapes may be superimposed and rotated synchronously with the Tacan signal, stopped, changed to another pattern, steered independently, turned on and off, all in microseconds; and in this fashion sector control of the Tacan antenna is feasible.

Still another further object is to modify the accepted Tacan antenna with supplementary ring arrays adjusted to align the troughs or peaks of the harmonics, or provide any superimposed relationship thereof in arriving at the desired pattern shape.

A further object is to utilize the harmonic technique or approach of the present invention to efficiently form and rotate any desired horizontal pattern including a beam; and in this connection, the width of the beam, the side lobe levels and band width are predictable.

An important object is to provide an antenna system capable of producing many idealized patterns, such as square wave, sawtooth, triangular, notch and spike simply by readjusting the relative phases of the harmonics. With the harmonics generated and controlled independently, an almost infinite variety of time functions may be produced which are without ambiguity and are unique in azimuth.

Another important object is to provide a flexible antenna design of the foregoing type which has the capability of continuously modifying and reshaping these patterns to enhance or deny communication with moving targets. The addition or integration of directional data with the range data already capable of being tracked by existing antenna configurations presents important new operational capabilities. These additional functions may be added with small penalty in weight and size.

Other objects and advantages will become apparent from the following detailed description which is to be taken in conjunction with the accompanying drawings.

DETAILED DESCRIPTION

Figure 1:
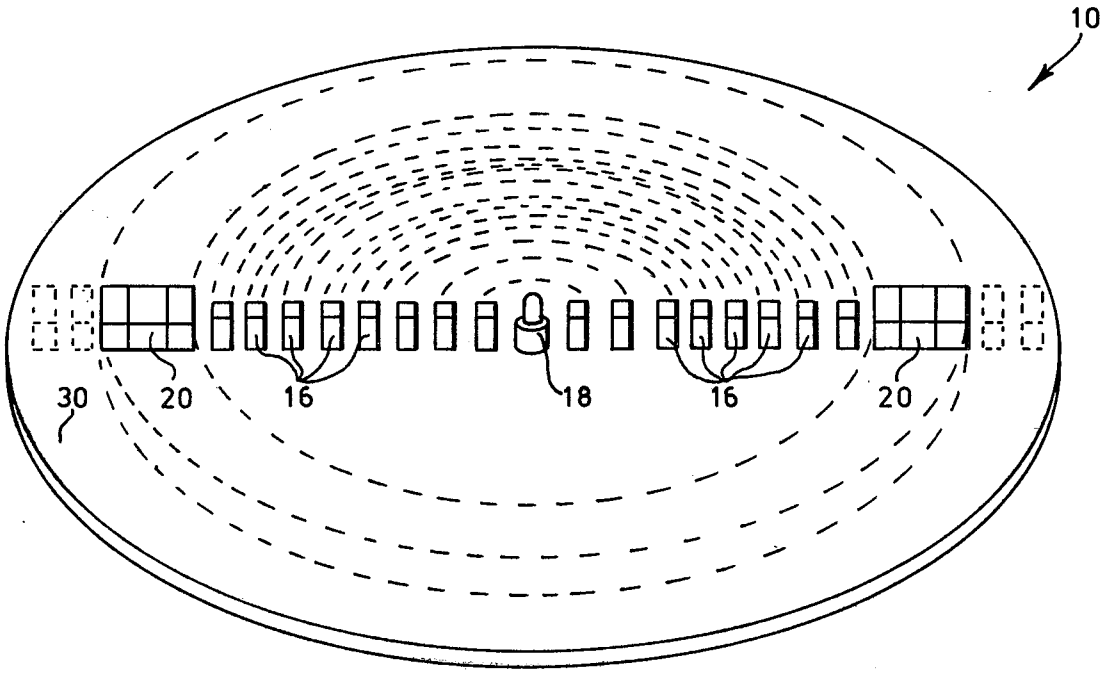
FIG. 1 is a diagrammatic elevation view of an antenna capable of generating multi-mode patterns according to the present invention.

In the drawings an antenna system 10 is shown capable of controlling a variety of patterns which in a specific contemplated application may enhance JTIDS (Joint Tactical Information Distribution System) operations and the possibility of forming and controlling a beam sufficiently narrow for other applications as well.

With the present invention many idealized patterns such as square waves, sawtooth, triangular, notch and spike may be readily produced simply by readjusting the relative phases of the harmonics. With the harmonics generated and controlled independently, an almost infinite variety of time functions may be produced which are without ambiguity and are unique in azimuth.

To form the patterns, spatial harmonics including the first through the eighth are adjusted in phase and amplitude to approximate the Fourier coefficients for the idealized form of the desired pattern. The harmonics are generated by ring arrays adjusted in radius to be near the first peak of the respective Bessel curves of order equal to the harmonic number.

For a disclosure and discussion of the parameters that determine parasitic placement and spacing for spatial harmonic generation in terms of Bessel coefficients and Fourier analysis, reference is made to "General Design Consideration for Tacan Transponder Antennas" by E. G. Parker and A. Casabone, 1957 IRE Wescon Convention Record, Volume 2, Pages 91–98.

Since each harmonic may be independently controlled, the spatial pattern shapes may be superimposed and rotated synchronously with the Tacan signal, stopped, changed to another pattern, steered independently, turned on and off, all in microseconds.

Open concentric ring arrays are ideally suited to generate both odd and even harmonics and to combine them with arbitrary relative phases to form any desired pattern in the horizontal plane. Each ring may contain a convenient number of elements 14 chosen to result in nominal element spacing and practical frequencies for timing control.

For many idealized patterns, the elements 14 of all rings may be identical. This is true since an amplitude ratio between the harmonics inversely proportional to their order is approximated with identical elements and is the same ratio required in many of the simple idealized functions. For generating and establishing the phases of the various harmonics, two approaches are contemplated, namely, (i), a vernier-like technique similar to that employed in the Tacan antenna offered by ITT, and (ii) the element spacing technique. The former is preferred because phase determinations many times more accurate are attainable. A relatively simple configuration of identical elements 16 in all rings is employed capable of being stepped smoothly using the vernier-like techniques derived from the prior art (Tacan antenna).

Figure 2:
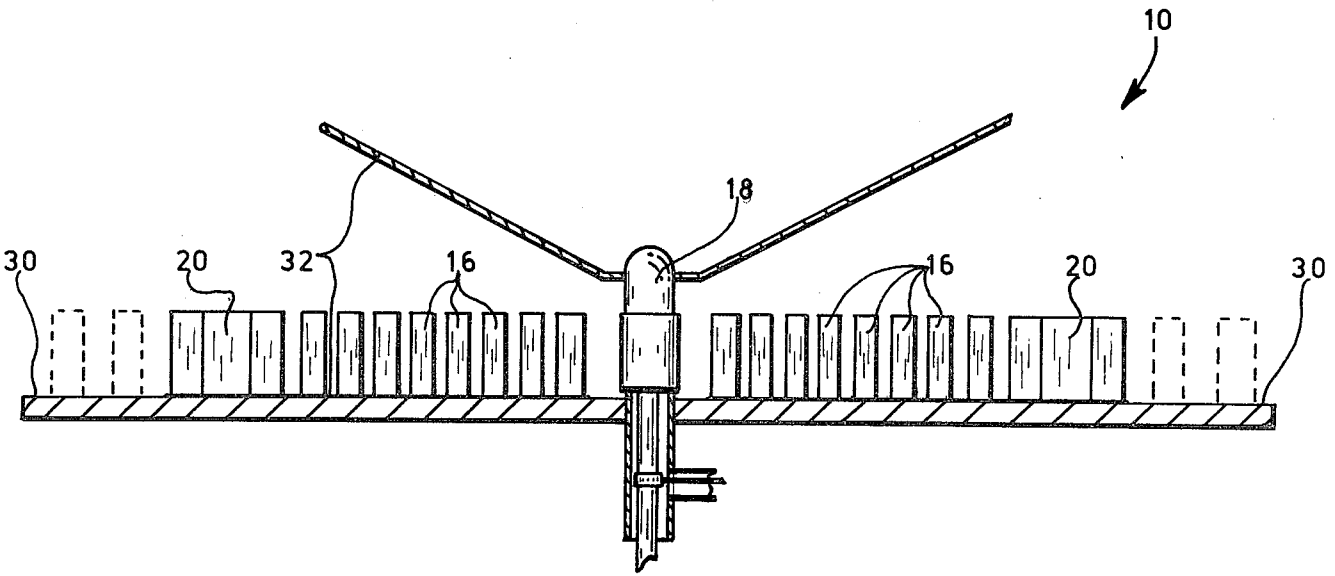
FIG. 2 is a perspective view thereof.

The antenna 10 utilizes switched parasites 16 to generate and rotate the spatial harmonics. The radiating portion of the antenna is shown in FIGS. 1 and 2. The capability for generating a wide variety of predictable pattern shapes across the L-band depends upon the stability in both amplitude and phase of the re-radiation from the switched parasites. The amplitudes are controlled by adjusting the value of resistors 12 placed at the base of the monopoles 14 of the parasitic elements 16. The change in phase in turn is dependent upon the change in self-impedance of the parasites 16 and the change in electrical length of the excitation distance to the central feed element 18.

For the Tacan, the simple parasites 20 used for generating the ninth harmonic are capable of good performance over only one third of the band. This is satisfactory for fixed frequency Tacan service since the band may be divided into three groups of channels with a switch to select one of three sets of parasites which are scaled for the appropriate frequencies. A triple parasite assembly utilized in Tacan is schematically shown as the 135 Hz element in FIG. 1.

Because of frequency hopping in JTIDS it would be necessary to selectively activate different groupings of parasites, dependent on the transmitted or received frequencies, to obtain a given directive pattern at all frequencies in the band. As an alternative, use of phase and amplitude compensated parasites could provide uniform pattern functions at all frequencies from a single grouping of active elements. From the standpoint of minimizing control complexity, a compensated parasite is needed which can provide good performance across the entire band.

A compensated parasite 16 for this application (JTIDS) exhibits both constant amplitude and phase of the re-radiated signal. For synthesizing patterns with deep minimas, it is especially important to control the electrical phase of each harmonic. The total change in phase is the sum of the changes in self-impedance phase and the excitation phase resulting from the change in the electrical radius with frequency. The change in electrical radius is readily calculated by multiplying the radius by the fractional change in frequency. Furthermore, this change is always to delayed phase of higher frequencies.

In order to provide compensation it is necessary to incorporate circuit elements within the parasite 16 which cause the current phase to advance with increase in frequency. The equivalent impedance of a simple parallel tuned R.L.C. circuit will exhibit this characteristic at frequencies near resonance. A loaded quarter wave shorted transmission line approximates this circuit and is more practical at these frequencies than lumped components. The transmission line also provides a convenient means of adjusting the frequency characteristics by selecting appropriate values of characteristic impedance for the line section.

Figure 3:
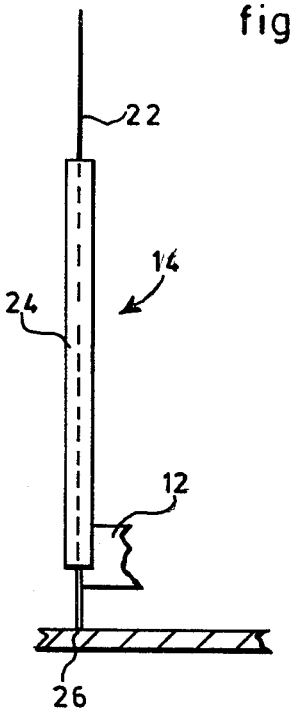
FIG. 3 is a schematic view of a parasitic element usable with this invention.
Figure 4:
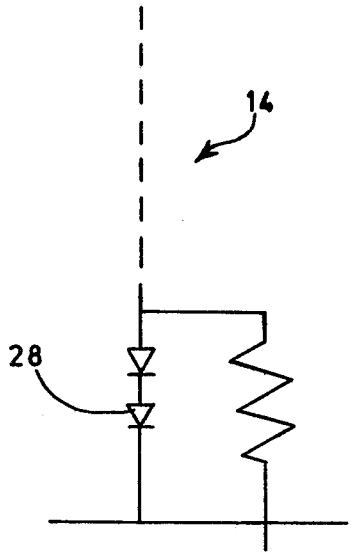
FIG. 4 is a schematic view of the switch network for each parasitic element.

An element 14 with substantially improved properties has been successfully operated through the seventh harmonic and this element is presented in FIG. 3 . It consists of a metallic rod conductor 22 which in the successful embodiment was 1¼ inches in length and was attached directly to a 25 ohm coaxial transmission line 24. This transmission line 24 is short-circuited at the point of contact with the rod and open-circuited at the base. Electrically, the coaxial line 24 in the above embodiment approximated a quarter wave shorted section with 220 ohms shunting the open end. The base 26 of the device is a capacitor formed from strip line material and serves only as a low impedance coupling to the antenna ground plane.

In conjunction with the parasite, a switching device is employed. In this connection the diode switch 28 operates satisfactorily and has good "on" and "off" current ratios across the band and should prove satisfactory for dynamic control of all spatial harmonics through the seventh. Incidentally the seventh harmonic is the highest planned for JTIDS use.

One of the most important aspects of the discone radiator including counterpoise 30 and cone 32 is the improvement in pattern shaping obtained relative to the monopole 18 over counterpoise 30 antenna. With the monopole-over-counterpoise configuration in a successful application of this invention, the signal level increases monatonically from approximately −10 dB at −30° elevation to a peak of approximately +5.6 dB which occurs in the region of 25° to 30° elevation. The discone antenna will have somewhat less peak gain but there is an improvement in energy distribution. The improved horizon gain together with the more uniform amplitude characteristics of the discone antenna 10 provide improved operational margins. As an added bonus, modification of the elevation pattern also results in substantial improvement in the modulation tracking for the 135 Hz bearing signals.

Thus, the present invention envisions applying pattern shaping techniques for sector control of Tacan for navigational systems. In a successful application the Tacan antenna was scanned electronically while the supplementary ring arrays were adjusted to align the troughs of the harmonics, forming a deep notch in one direction. In the notch the signal dropped to very low levels. The residual signal consisted almost entirely of harmonics of the side bands with no reference carrier. At other azimuths, both modulation components (carried and harmonics) appeared uniform and stable.

If the peaks of the harmonics are aligned, a good beam about 30° wide is formed. In this connection, the side lobe levels are very low.

The square waves and sawtooth patterns, if rotated synchronously with the Tacan signal offer potential improvements in bearing accuracy and simplification of airborne receivers.

The sawtooth pattern and square wave pattern also provide means of producing modulated signals in only selected directions. With the steep step of the pattern directed toward the receiver, an amplitude modulated signal will result from only slight annular movement of the pattern.

Anyone of several parasite switching systems within the perview of those skilled in the art may be employed to provide the various harmonics desired and consequently the pattern selected. For example, the switching may be accomplished mechanically by a commutator-type switch the rotation of which is related to the order of harmonic to be deployed. The switching may also be done electrically by a circulating register system and vernier-like technique as currently used in Tacan but modified to provide the desired switching sequence and thus the various harmonics desired.

The vernier technique determines geometry of the arrays and particularly the location and number of parasitic elements for the selected harmonics.

Thus, in generating a harmonic, other than a multiple thereof of parasitic elements are utilized and the number actually utilized should provide the desired granularity within the specified time domain. For example, 10 parasitic elements for providing the third harmonic with the elements numbered 1–10 in a clockwise direction, will be fired in the following sequence:

| Event | On | Off |
|---|---|---|
| 1 | 1 | 10 |
| 2 | 8 | 7 |
| 3 | 5 | 4 |
| 4 | 2 | 1 |
| 5 | 9 | 8 |
| 6 | 6 | 5 |
| 7 | 3 | 2 |
| 8 | 10 | 9 |
| 9 | 7 | 6 |
| 10 | 4 | 3 |

Figure 5:
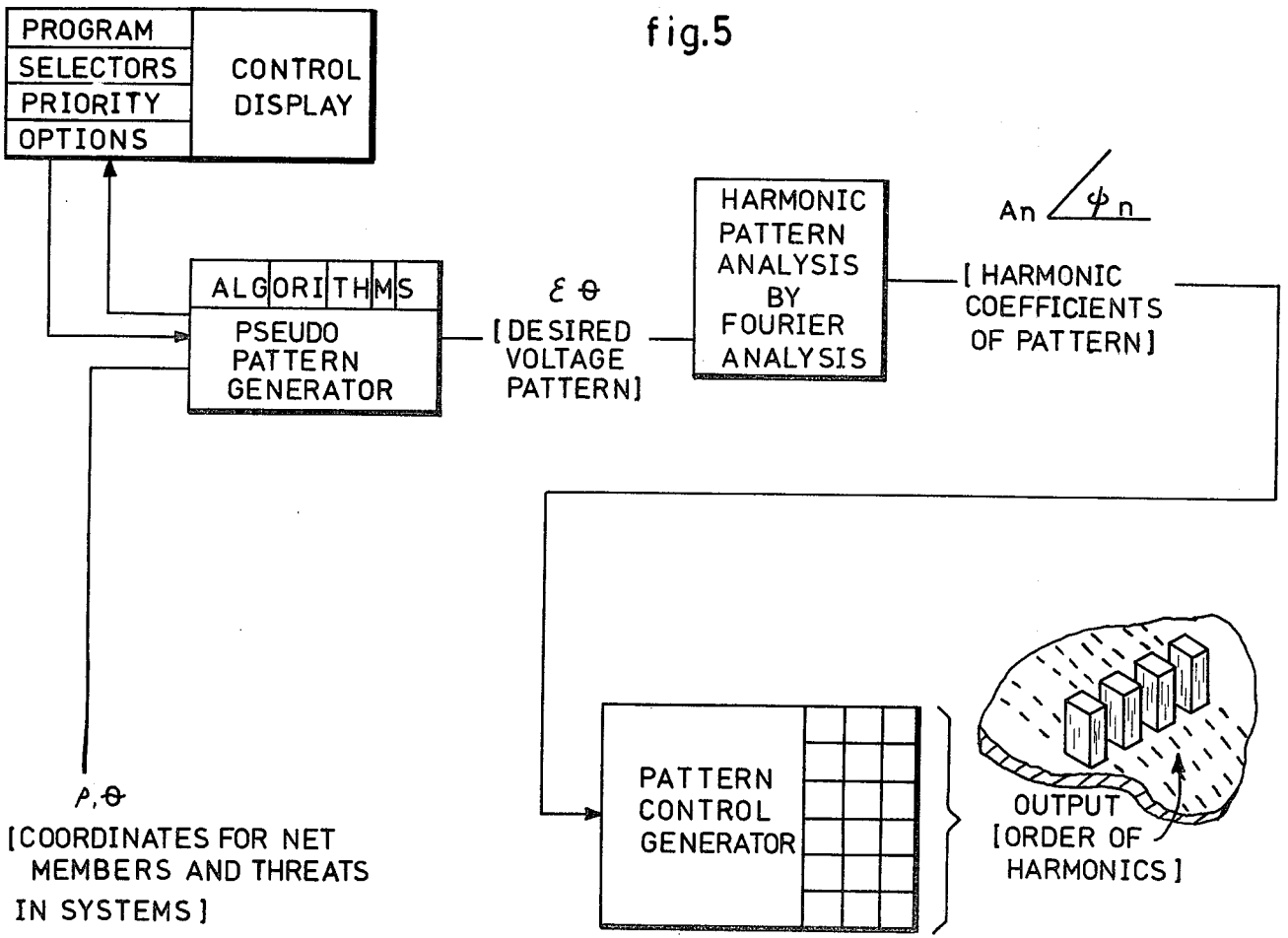
FIG. 5 is a functional block diagram of a representative system for generating the spatial harmonic components of the pattern.

Referring now to the functional diagram of FIG. 5, the $\rho$, $\theta$, coordinates for the net of members (friends) and threats in the JTIDS system are fed to the psuedo pattern generator 40, the electronics of which will be determined by the military, but in most events will include micro-processing equipment and allied componentry. The generator 40 will be governed by different algorithyms established by the military. A control display 42 having the appropriate programs, selectors, indicated priorities and options would also be conveniently available for controlling the operation of the generator. The generator 40 produces the desired voltage pattern with $\epsilon$ being a function of the electric field and $\theta$ the azimuthal angle. This voltage pattern is fed to a harmonic pattern analyzer which performs the Fourier analysis. Once again, micro-processing equipment and logic control of available design will be utilized for such purposes. The analyzer 44 will generate the harmonic coefficients of pattern, A (amplitude), $\psi$ (phase). The phase is readily determined by existing Tacan generators while amplitude will be directly related to the number of elements turned on in the harmonic positions. The spatial harmonic components of pattern are fed to a pattern control generator 46. This generator could be designed to include the Tacan logic and register system as well as the vernier control discussed in the above. The output order of harmonics is then used to trigger the selected parasitic arrays and the elements therein, thereby producing the desired synthesized or shaped pattern. The functional diagram as well as the componentry required for implementation thereof does not per se constitute part of this invention which is concerned with pattern synthesis and shaping utilizing spatial harmonic components or coefficients of the pattern.

Thus, the several aforenoted objects and advantages are most effectively attained. Although a single somewhat preferred embodiment has been disclosed and described in detail herein, it should be understood that this invention is in no sense limited thereby and its scope is to be determined by that of the appended claims.

What is claimed is:

1. An antenna for radiation pattern synthesis over a defined frequency band using the technique of spatial harmonics, comprising:

a counterpoise;

a monopole radiator for generating electromagnetic radiation at a frequency within the band;

coupling means for coupling the monopole radiator to a source of power;

a plurality of concentric ring arrays of compensated parasitic antenna elements excitable by and concentric with respect to the monopole radiator having the capability of generating a plurality of predetermined harmonic radiation patterns and means for establishing a different harmonic radiation pattern for each array, each ring array adjusted in radius to be near the first peak of the Bessel curves of order equal to the harmonic number;

control means for activating the parasitic antenna elements in a predetermined manner to generate a predetermined number of the first through eighth harmonics and consequently spatial harmonic radiation to form a predetermined electromagnetic wave pattern; and means for adjusting the predetermined harmonics in phase and amplitude to approximate the applicable Fourier coefficients for the predetermined wave pattern.

2. The invention in accordance with claim 1, wherein a cone radiator is coupled with the monopole radiator for cooperating in exciting the parasitic antenna elements.

3. The invention in accordance with claim 1 wherein the arrays are designed to produce the 2nd through the 8th harmonic of the fundamental.

4. The invention in accordance with claim 1 wherein the parasitic antenna elements have means for amplitude and phase compensation for permitting the antenna to operate over the entire frequency band.

5. The invention in accordance with claim 4, wherein the means for phase compensation incorporates circuit elements within the parasitic antenna elements which cause the current phase of the parasitic antenna elements to advance with increase in frequency.

6. The invention in accordance with claim 5, wherein the parasitic antenna element includes a metallic rod and the circuit elements includes a coaxial cable line and a resistor shunting one of the ends of the coaxial cable.

7. The invention in accordance with claim 4, wherein an array of parasitic elements are provided for generating the ninth harmonic, the elements are uncompensated and are sized for predetermined portions of the frequency band.

8. The invention in accordance with claim 1, wherein switch means causes the activation of the parasitic antenna elements.

9. The invention in accordance with claim 8, wherein the switch means includes switch diodes.

* * * * *